US009874892B2

(12) United States Patent
Kim

(10) Patent No.: US 9,874,892 B2
(45) Date of Patent: Jan. 23, 2018

(54) INTERNAL VOLTAGE GENERATION DEVICE

(71) Applicant: SK hynix Inc., Icheon-si, Gyeonggi-do (KR)

(72) Inventor: Yeon Uk Kim, Icheon-si (KR)

(73) Assignee: SK hynix Inc., Icheon-si, Gyeonggi-do (KR)

( * ) Notice: Subject to any disclaimer, the term of this patent is extended or adjusted under 35 U.S.C. 154(b) by 224 days.

(21) Appl. No.: 14/873,597

(22) Filed: Oct. 2, 2015

(65) Prior Publication Data

US 2016/0349784 A1 Dec. 1, 2016

(30) Foreign Application Priority Data

May 26, 2015 (KR) ..... 10-2015-0072664

(51) Int. Cl.

| | |
|---|---|
| ***G05F 1/46*** | (2006.01) |
| ***G05F 3/08*** | (2006.01) |
| *G05F 1/575* | (2006.01) |
| *G05F 1/10* | (2006.01) |
| *G05F 3/02* | (2006.01) |

(52) U.S. Cl.

CPC ..... *G05F 3/08* (2013.01); *G05F 1/465* (2013.01); *G05F 1/10* (2013.01); *G05F 1/462* (2013.01); *G05F 1/575* (2013.01); *G05F 3/02* (2013.01)

(58) Field of Classification Search

CPC ... G05F 1/10; G05F 3/02; G05F 1/462; G05F 1/465; G05F 1/575

See application file for complete search history.

(56) References Cited

U.S. PATENT DOCUMENTS

| | | | | |
|---|---|---|---|---|
| 5,349,559 | A * | 9/1994 | Park | G05F 1/465 327/541 |
| 8,254,185 | B2 | 8/2012 | Cho | |
| 2002/0024380 | A1* | 2/2002 | Kono | G05F 5/00 327/541 |
| 2007/0069809 | A1* | 3/2007 | Kang | G05F 1/465 327/541 |
| 2008/0042730 | A1* | 2/2008 | Kang | G05F 1/465 327/536 |
| 2008/0278126 | A1* | 11/2008 | Kang | G05F 1/465 323/274 |
| 2009/0168585 | A1* | 7/2009 | Kang | G11C 5/143 365/226 |
| 2011/0241768 | A1* | 10/2011 | Jung | G11C 7/02 327/538 |
| 2012/0218019 | A1* | 8/2012 | Lee | G11C 5/145 327/331 |
| 2016/0006348 | A1* | 1/2016 | Ho | G11C 16/30 327/536 |

FOREIGN PATENT DOCUMENTS

KR 1020050063053 A 6/2005

* cited by examiner

*Primary Examiner* — Fred E Finch, III
*Assistant Examiner* — Rafael O De Leon Domenech
(74) *Attorney, Agent, or Firm* — William Park & Associates Ltd.

(57) ABSTRACT

An internal voltage generation device includes a voltage generation block configured to compare a reference voltage and a divided voltage, and generate an output voltage; and an internal voltage driving block including a pull-up driving unit which selectively pull-up drives an internal voltage according to the output voltage, and configured to output the output voltage to the pull-up driving unit through different paths according to a test signal.

30 Claims, 3 Drawing Sheets

INTERNAL VOLTAGE GENERATION DEVICE

CROSS-REFERENCES TO RELATED APPLICATION

The present application claims priority under 35 U.S.C. § 119(a) to Korean application number 10-2015-0072664, filed on May 26, 2015, in the Korean Intellectual Property Office, which is incorporated herein by reference in its entirety.

BACKGROUND

1. Technical Field

Various embodiments generally relate to an internal voltage generation device, and more particularly, to a technology for stably supplying an internal voltage.

2. Related Art

As the degree of integration of a DRAM (dynamic random access memory) increases and a higher voltage is used as an external power supply voltage, the reliability of transistors is likely to be degraded.

In order to cope with this problem, a voltage conversion circuit for decreasing a power supply voltage in a chip is being actively adopted. If a lower power supply voltage is used, power consumption may be reduced, and if a constant voltage is set as an internal voltage source, the operation of a chip may be stabilized since a stable power supply voltage may be secured even though an external power supply voltage varies.

However, because load variations severely occur in a peripheral circuit or a memory array which is supplied with an internal voltage (VINT), it is difficult to design a circuit capable of stably performing an operation, in a DRAM.

SUMMARY

In an embodiment, an internal voltage generation device may include a voltage generation block configured to compare a reference voltage and a divided voltage, and generate an output voltage. The internal voltage generation device may also include an internal voltage driving block including a pull-up driving unit which selectively pull-up drives an internal voltage according to the output voltage, and configured to output the output voltage to the pull-up driving unit through different paths according to a test signal.

In an embodiment, an internal voltage generation device may include a voltage generation block configured to compare a reference voltage and a divided voltage, and generate an output voltage. The internal voltage generation device may also include a pull-up driving unit configured to selectively pull-up drive an internal voltage according to the output voltage. The internal voltage generation device may also include a test control unit configured to drive a test signal. The internal voltage generation device may also include a digital driving unit configured to control the output voltage to a logic level according to an output of the test control unit, and output the logic level to the pull-up driving unit. Further, the internal voltage generation device may include an analog driving unit configured to output the output voltage to the pull-up driving unit according to the output of the test control unit.

In an embodiment, an internal voltage generation device includes a voltage generation block configured to generate an output voltage and amplify a resultant signal and output the output voltage. The internal voltage generation device may also include an internal voltage driving block configured to receive the output voltage and pull-up drive a power supply voltage according to an output of a digital driving unit and an output of an analog driving unit.

The voltage generation block comprises: a comparison unit configured to compare the reference voltage and the divided voltage; a biasing unit configured to supply a biasing voltage to the comparison unit; and a driving unit configured to drive an output of the comparison unit and output the output voltage.

The test control unit comprises: a first inverter configured to invert the test signal; and a second inverter configured to invert an output of the first inverter.

In the internal voltage driving block, the digital driving unit operates where the test signal is a high level, and the analog driving unit operates where the test signal is a low level.

In the internal voltage driving block, the analog driving unit is floated where the test signal is a high level, and the digital driving unit is floated where the test signal is a low level.

The digital driving unit comprises: a first NAND gate configured to perform a NAND logic function on the second signal and the output voltage; and a third inverter configured to invert an output of the first NAND gate in correspondence to the first signal and the second signal.

The internal voltage generation device according to claim 9, wherein the third inverter is a tri-state inverter.

The third inverter comprises: a first PMOS transistor configured to pull-up drive a power supply voltage in correspondence to the output of the first NAND gate; a first NMOS transistor configured to pull-down drive a ground voltage in correspondence to the output of the first NAND gate; a second PMOS transistor electrically coupled between the first PMOS transistor and an output terminal of the third inverter, and configured to be controlled by the first signal; and a second NMOS transistor electrically coupled between the first NMOS transistor and the output terminal of the third inverter, and configured to be controlled by the second signal.

In the third inverter, the second PMOS transistor and the second NMOS transistor are turned on when the test signal is a high level, and the first PMOS transistor and the first NMOS transistor are selectively turned on in correspondence to the output voltage.

In the third inverter, the second PMOS transistor and the second NMOS transistor are turned off when the test signal is a low level, and the third inverter is floated.

The analog driving unit outputs the output voltage to the pull-up driving unit where the test signal is a low level, and is floated where the test signal is a high level.

The pull-up driving unit comprises a third PMOS transistor configured to supply the power supply voltage to an output terminal of the internal voltage in correspondence to the output voltage.

DETAILED DESCRIPTION

Hereinafter, an internal voltage generation device will be described below with reference to the accompanying figures through various embodiments. Various embodiments are directed to an internal voltage generation device capable of generating a stable internal voltage by selectively using an analog circuit and a digital circuit. In the internal voltage generation device according to the embodiments, advantages are provided in that a stable internal voltage may be generated by selectively using an analog circuit and a digital circuit.

Figure 1:
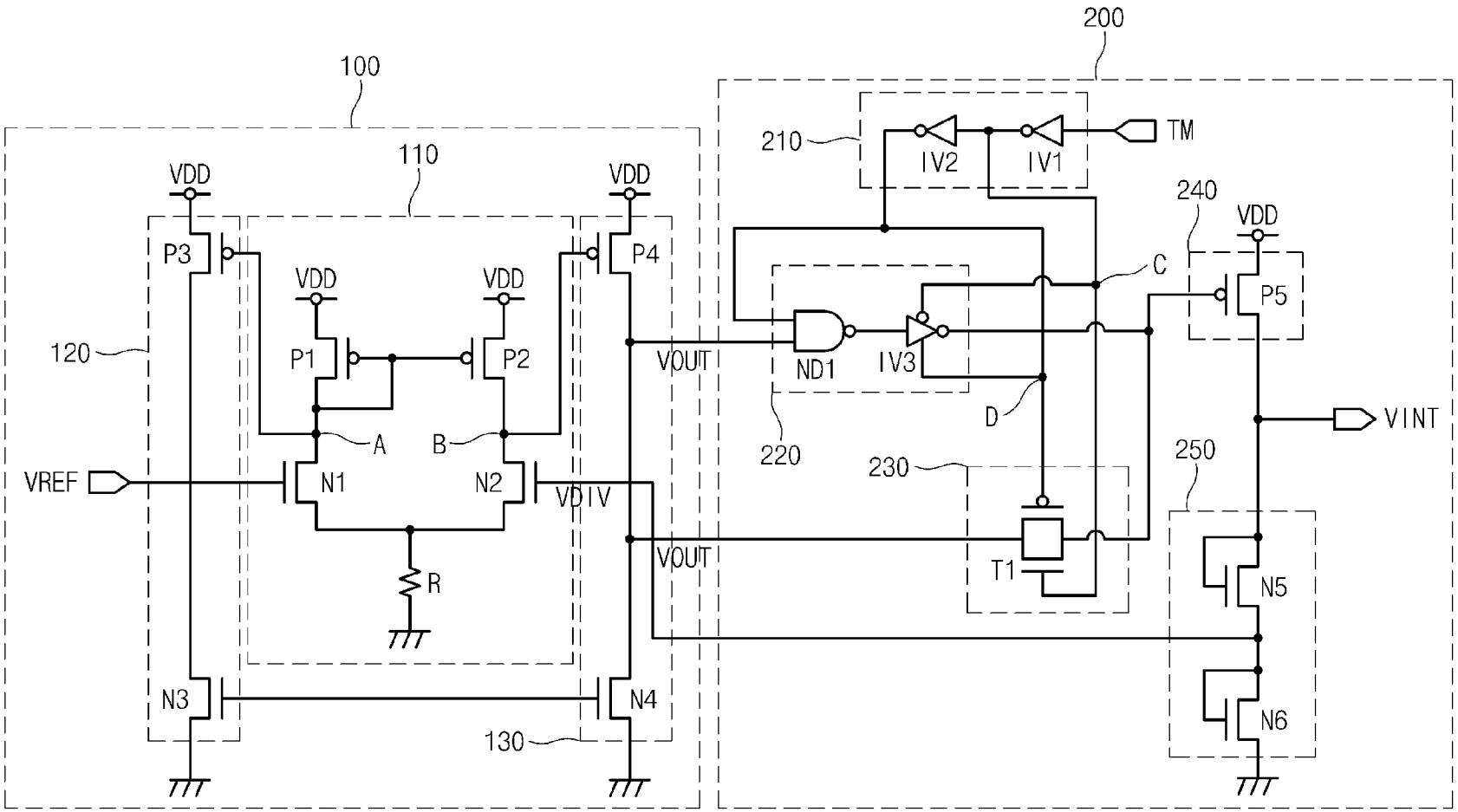
FIG. 1 is a configuration diagram illustrating a representation of an example of an internal voltage generation device in accordance with an embodiment.

Referring to FIG. 1, a configuration diagram illustrating a representation of an example of an internal voltage generation device in accordance with an embodiment is illustrated.

A memory device generates a power source of a required magnitude by using an external power supply voltage equal to or lower than a predetermined value, and uses the generated power source. For low power consumption of a DRAM and reduction of influences by external power, an internal voltage (VINT) having a potential lower than an external supply voltage supplied from an exterior is used in a core region in the DRAM.

In particular, in the case of a memory device like a DRAM, using bit line sense amplifiers, a core voltage (VCORE) is mainly used as an internal voltage (VINT) to sense cell data.

An internal driver for generating the level of the core voltage (VCORE) is referred to as a core voltage driver. As the operation of a DRAM is gradually speeded up, the high speed operation of cells should become possible. As the operation of a DRAM is gradually speeded up, the level of the core voltage (VCORE) of cells requires quick charging capability.

An internal voltage generation device in accordance with an embodiment includes a voltage generation block 100 and an internal voltage driving block 200. The voltage generation block 100 includes a comparison unit 110, a biasing unit 120, and a driving unit 130. The internal voltage driving block 200 includes a test control unit 210, a digital driving unit 220, an analog driving unit 230, a pull-up driving unit 240, and a voltage division unit 250.

The voltage generation block 100 generates an output voltage VOUT by comparing a reference voltage VREF and a divided voltage VDIV and amplifying a resultant signal. The voltage generation block 100 also outputs the output voltage VOUT to the internal voltage driving block 200.

The comparison unit 110 compares the reference voltage VREF and the divided voltage VDIV. The comparison unit 110 includes PMOS transistors P1 and P2, NMOS transistors N1 and N2, and a resistor R. The PMOS transistors P1 and P2 have a common gate terminal which is electrically coupled to a node A and source terminals to which a power supply voltage VDD is applied.

The NMOS transistors N1 and N2 are electrically coupled in parallel between nodes A and B and the resistor R. The NMOS transistor N1 is applied with the reference voltage VREF through a gate terminal. The NMOS transistor N2 is applied with the divided voltage VDIV through a gate terminal. The resistor R is electrically coupled between the common source terminal of the NMOS transistors N1 and N2 and the application terminal of a ground voltage.

The biasing unit 120 supplies a biasing voltage to the comparison unit 110. The biasing unit 120 includes a PMOS transistor P3 and an NMOS transistor N3 electrically coupled in series between the application terminal of the power supply voltage VDD and the application terminal of the ground voltage. The PMOS transistor P3 has a gate terminal electrically coupled to the node A. The NMOS transistor N3 is electrically coupled in common with the gate terminal of the NMOS transistor N4.

The driving unit 130 drives the output of the comparison unit 110 and outputs it to the internal voltage driving block 200. The driving unit 130 includes a PMOS transistor P4 and an NMOS transistor N4 electrically coupled in series between the application terminal of the power supply voltage VDD and the application terminal of the ground voltage. The PMOS transistor P4 has a gate terminal electrically coupled to the node B. The NMOS transistor N4 has a gate terminal electrically coupled in common with the gate terminal of the NMOS transistor N3.

The test control unit 210 drives a test signal TM in a non-inverting manner. The test control unit 210 also outputs a resultant signal to the digital driving unit 220 and the analog driving unit 230. The test control unit 210 includes inverters IV1 and IV2 electrically coupled in series. The inverter IV1 drives the test signal TM in an inverting manner. The inverter IV1 outputs a resultant signal to the analog driving unit 230. The inverter IV2 delays the test signal TM in a non-inverting manner. The inverter IV2 also outputs a resultant signal to the digital driving unit 220 and the analog driving unit 230.

In an embodiment, the test signal TM is described as a signal for controlling the driving of the digital driving unit 220 and the analog driving unit 230. However, the embodiment is not limited to such an example. Further, a signal for sensing the level of the power supply voltage VDD may be used to control the driving of the digital driving unit 220 and the analog driving unit 230.

The digital driving unit 220 combines the output of the test control unit 210 and the output voltage VOUT. The digital driving unit 220 also outputs a resultant signal to the pull-up driving unit 240. The digital driving unit 220 includes a NAND gate ND1 and an inverter IV3. The NAND gate ND1 NANDs or performs a NAND logic function on the output of the inverter IV2 and the output voltage VOUT. The inverter IV3 inverts the output of the NAND gate ND1. The inverter IV3 also outputs a resultant signal to the pull-up driving unit 240.

The analog driving unit 230 selectively outputs the output voltage VOUT to the pull-up driving unit 240 in correspondence to the output of the test control unit 210. The analog driving unit 230 includes a transmission gate T1. The transmission gate T1 includes a PMOS gate terminal to which the output of the inverter IV2 is applied and an NMOS gate terminal to which the output of the inverter IV1 is applied. In an embodiment, the digital driving unit 220 and the analog driving unit 230 operate complementarily to each other.

In an embodiment, the digital driving unit 220 and the analog driving unit 230 are selected in correspondence to the test signal TM or the signal for sensing the level of the power supply voltage VDD. Further, the output voltage VOUT of the voltage generation block 100 is transferred to the pull-up driving unit 240 through different paths.

The pull-up driving unit 240 pull-up drives the power supply voltage VDD according to the output of the digital driving unit 220 and the output of the analog driving unit 230. The pull-up driving unit 240 includes a PMOS transistor P5. The PMOS transistor P5 is electrically coupled between the application terminal of the power supply voltage VDD and the output terminal of an internal voltage VINT. The PMOS transistor P5 is applied with the output of the digital driving unit 220 and the output of the analog driving unit 230 through a gate terminal.

The voltage division unit 250 divides the internal voltage VINT, and outputs the divided voltage VDIV to the comparison unit 110. The voltage division unit 250 includes NMOS transistors N5 and N6 electrically coupled in series between the output terminal of the internal voltage VINT and the application terminal of the ground voltage. The common coupling terminal of the NMOS transistors N5 and N6 is electrically coupled with the gate terminal of the NMOS transistor N2.

The NMOS transistor N5 has a gate terminal and a drain terminal electrically coupled in common. The NMOS transistor N6 has a gate terminal and a drain terminal electrically coupled in common. For example, the voltage division unit 250 may output the divided voltage VDIV which has a ½ voltage level of the internal voltage VINT.

Figure 2:
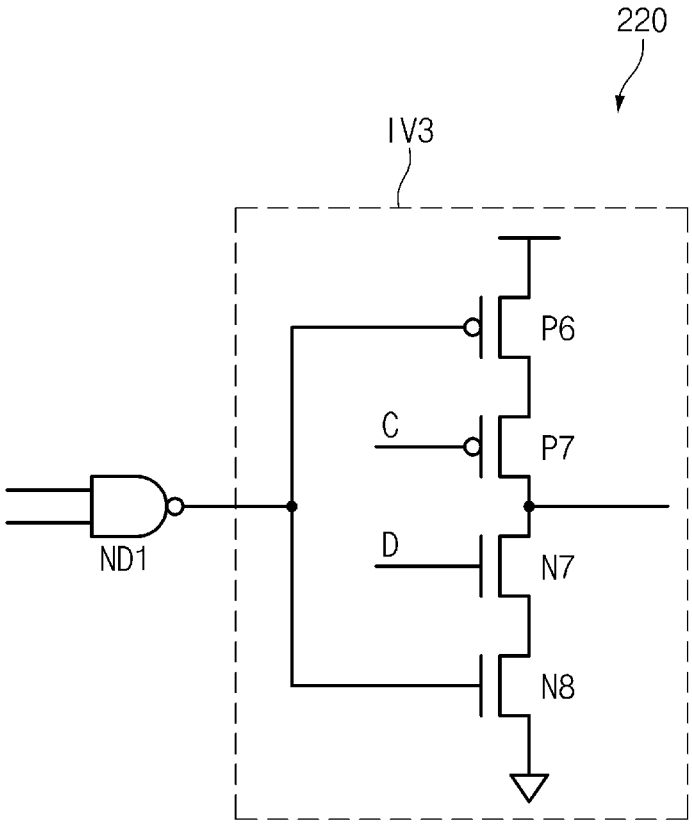
FIG. 2 is a detailed circuit diagram illustrating a representation of an example of the digital driving unit shown in FIG. 1.

Referring to FIG. 2, a detailed circuit diagram illustrating a representation of an example of the digital driving unit 220 shown in FIG. 1 is described.

The inverter IV3 of the digital driving unit 220 includes PMOS transistors P6 and P7 and NMOS transistors N7 and N8 electrically coupled in series between the terminal of the power supply voltage VDD and the terminal of the ground voltage. The PMOS transistor P6 and the NMOS transistor N8 have a common gate terminal electrically coupled to the output terminal of the NAND gate ND1. The PMOS transistor P7 has a gate terminal electrically coupled to a node C. Further, the NMOS transistor N7 has a gate terminal electrically coupled to a node D.

The inverter IV3 is a tri-state inverter driven according to the output of the NAND gate ND1 and the states of the nodes C and D.

For example, if the test signal TM is a high level, the node C is a low level and the node D is a high level. According to this fact, in the case where the output voltage VOUT is a high level, the PMOS transistor P6 is turned on, and the output of the inverter IV3 is a high level. Where the output voltage VOUT is a low level, the NMOS transistor N8 is turned on, and the output of the inverter IV3 is a low level.

Conversely, if the test signal TM is a low level, the node C is a high level and the node D is a low level. According to this fact, the PMOS transistor P7 and the NMOS transistor N7 are turned off, and the inverter IV3 becomes a floating state regardless of the output of the NAND gate ND1.

Operations of the internal voltage generation device in accordance with an embodiment, configured as mentioned above, will be described below.

First, the divided voltage VDIV is supplied from the voltage division unit 250 to the comparison unit 110. The comparison unit 110 compares the reference voltage VREF and the divided voltage VDIV from the voltage division unit 250, and outputs a resultant signal to the driving unit 130. As the driving capabilities of the NMOS transistors N1 and N2 become different in correspondence to the reference voltage VREF and the divided voltage VDIV from the voltage division unit 250, the voltages of both output nodes A and B of the comparison unit 110 become different.

In other words, where the power supply voltage VDD from an exterior decreases, the output voltage VOUT of the driving unit 130 becomes the low level. According to this fact, the pull-up driving unit 240 is turned on, and the level of the internal voltage VINT is raised.

Conversely, where the power supply voltage VDD from the exterior increases, the output voltage VOUT of the driving unit 130 becomes the high level, and the pull-up driving unit 240 is turned off. In this case, the voltage level of the internal voltage VINT is not raised any more.

At this time, where the test signal TM is enabled to the high level, the digital driving unit 220 is turned on, and the analog driving unit 230 is turned off. The analog driving unit 230 becomes a floating state not to act as a parasitic capacitance.

Namely, if the test signal TM is the high level, the output of the inverter IV2 becomes the high level, and the pull-up driving unit 240 operates in correspondence to the level of the output voltage VOUT. For example, where the output voltage VOUT is the high level, the pull-up driving unit 240 is turned off, and, where the output voltage VOUT is the low level, the pull-up driving unit 240 is turned on.

Where the test signal TM is disabled to the low level, the analog driving unit 230 is turned on, and the digital driving unit 220 is turned off. The digital driving unit 220 becomes a floating state not to act as a parasitic capacitance.

Namely, if the test signal TM is the low level, the output of the inverter IV1 becomes the high level, and the output of the inverter IV2 becomes the low level.

Then, as the low level is applied to the PMOS gate of the transmission gate T1 and the high level is applied to the NMOS gate of the transmission gate T1, the transmission gate T1 is turned on. According to this fact, the output voltage VOUT of the voltage generation block 100 is outputted to the pull-up driving unit 240.

In this way, in an embodiment, when the test signal TM is enabled, the digital driving unit 220 operates and transfers a logic level, such that the output voltage VOUT may be quickly transferred to the output terminal. Moreover, in an embodiment, it is possible to suppress a degradation phenomenon that is otherwise likely to occur in the output terminal of the output voltage VOUT, and reduce a parasitic capacitance.

That is to say, an LDO (low drop output) type voltage generation device may achieve a high gain by using the comparison unit 110 which compares 2 inputs. However, to secure a stable pulse width, it is necessary to use a substantially large capacitor and thereby compensate for a frequency in a circuit.

If such compensation is employed a lot of times, the linearity of an output waveform may be secured. Nevertheless, since an operational performance may not be ensured in low power supply voltage circumstances, a low power supply voltage characteristic may deteriorate.

In this consideration, in an embodiment, the output of the voltage generation block 100 is transferred to the internal voltage driving block 200 through the digital driving unit 220 which is configured by logic gates, such that an operation may be quickly performed in low power supply voltage circumstances. In other words, where the digital driving unit 220 is operated, the transistor on/off characteristic of the pull-up driving unit 240 may be maximized, and thus, it is possible to compensate for a low power supply voltage operation characteristic.

In addition, in an embodiment, when the test signal TM is disabled, the analog driving unit 230 is operated, and thus, the internal voltage VINT may be stably generated in high power supply voltage circumstances.

Figure 3:
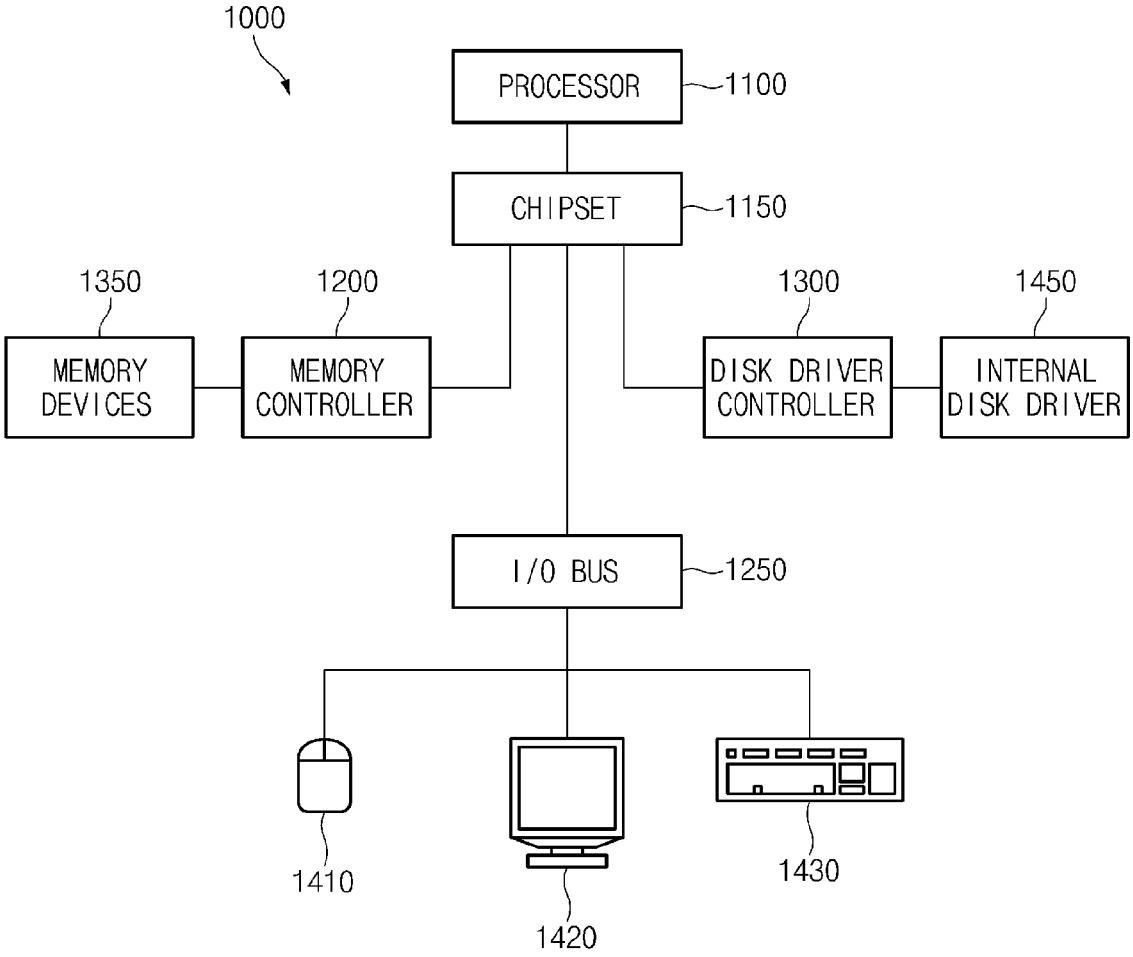
FIG. 3 illustrates a block diagram of a system employing a memory controller circuit in accordance with an embodiment of the invention.

Referring to FIG. 3, a system 1000 may include one or more processors 1100. The processor 1100 may be used individually or in combination with other processors. A chipset 1150 may be electrically coupled to the processor 1100. The chipset 1150 is a communication pathway for signals between the processor 1100 and other components of the system 1000. Other components may include a memory controller 1200, an input/output (I/O) bus 1250, and a disk driver controller 1300. Depending on the configuration of the system 1000, any one of a number of different signals may be transmitted through the chipset 1150.

The memory controller 1200 may be electrically coupled to the chipset 1150. The memory controller can receive a request provided from the processor 1100 through the chipset 1150. The memory controller 1200 may be electrically coupled to one or more memory devices 1350. The memory device 1350 may include the internal voltage generation device described above.

The chipset 1150 may also be electrically coupled to the I/O bus 1250. The I/O bus 1250 may serve as a communication pathway for signals from the chipset 1150 to I/O devices 1410, 1420 and 1430. The I/O devices 1410, 1420 and 1430 may include a mouse 1410, a video display 1410, or a keyboard 1430. The I/O bus 1250 may employ any one of a number of communications protocols to communicate with the I/O devices 1410, 1420 and 1430.

The disk driver controller 1300 may also be electrically coupled to the chipset 1150. The disk driver controller 1300 may serve as the communication pathway between the chipset 1150 and one or more internal disk driver 1450. The disk driver controller 1300 and the internal disk driver 1450 may communicate with each other or with the chipset 1150 using virtually any type of communication protocol.

While various embodiments have been described above, it will be understood to those skilled in the art that the embodiments described are by way of examples only. Accordingly, the internal voltage generation device described should not be limited based on the described embodiments.

What is claimed is:

1. An internal voltage generation device comprising:

a voltage generation block configured to compare a reference voltage and a divided voltage, and generate an output voltage; and an internal voltage driving block including a pull-up driving unit which selectively pull-up drives an internal voltage according to the output voltage, and configured to output the output voltage to the pull-up driving unit through different paths according to a test signal, wherein the internal voltage driving block comprises:

a test control unit configured to drive the test signal and output a first signal and a second signal;

a digital driving unit configured to control the output voltage to a logic level according to the first signal and the second signal which is an inverted signal of the first signal, and output the logic level to the pull-up driving unit; and an analog driving unit configured to output the output voltage to the pull-up driving unit according to the first signal and the second signal.

2. The internal voltage generation device according to claim 1, wherein the voltage generation block comprises:

a comparison unit configured to compare the reference voltage and the divided voltage;

a biasing unit configured to supply a biasing voltage to the comparison unit; and a driving unit configured to drive an output of the comparison unit and output the output voltage.

3. The internal voltage generation device according to claim 1, wherein the test control unit comprises:

a first inverter configured to invert the test signal; and a second inverter configured to invert an output of the first inverter.

4. The internal voltage generation device according to claim 1, wherein the digital driving unit and the analog driving unit operate complementarily to each other.

5. The internal voltage generation device according to claim 1, wherein, in the internal voltage driving block, the digital driving unit operates where the test signal is a high level, and the analog driving unit operates where the test signal is a low level.

6. The internal voltage generation device according to claim 1, wherein, in the internal voltage driving block, the analog driving unit is floated where the test signal is a high level, and the digital driving unit is floated where the test signal is a low level.

7. The internal voltage generation device according to claim 1, wherein the digital driving unit outputs a signal corresponding to a level of the output voltage to the pull-up driving unit where the test signal is a high level, and is floated where the test signal is a low level.

8. The internal voltage generation device according to claim 3, wherein the digital driving unit comprises:

a first NAND gate configured to perform a NAND logic function on the second signal and the output voltage; and a third inverter configured to invert an output of the first NAND gate in correspondence to the first signal and the second signal.

9. The internal voltage generation device according to claim 8, wherein the third inverter is a tri-state inverter.

10. The internal voltage generation device according to claim 8, wherein the third inverter comprises:

a first PMOS transistor configured to pull-up drive a power supply voltage in correspondence to the output of the first NAND gate;

a first NMOS transistor configured to pull-down drive a ground voltage in correspondence to the output of the first NAND gate;

a second PMOS transistor electrically coupled between the first PMOS transistor and an output terminal of the third inverter, and configured to be controlled by the first signal; and a second NMOS transistor electrically coupled between the first NMOS transistor and the output terminal of the third inverter, and configured to be controlled by the second signal.

11. The internal voltage generation device according to claim 10, wherein, in the third inverter, the second PMOS transistor and the second NMOS transistor are turned on when the test signal is a high level, and the first PMOS transistor and the first NMOS transistor are selectively turned on in correspondence to the output voltage.

12. The internal voltage generation device according to claim 10, wherein, in the third inverter, the second PMOS transistor and the second NMOS transistor are turned off when the test signal is a low level, and the third inverter is floated.

13. The internal voltage generation device according to claim 1, wherein the analog driving unit comprises a transmission gate configured to be selectively turned on in correspondence to the first signal and the second signal and transfer the output voltage.

14. The internal voltage generation device according to claim 13, wherein the analog driving unit outputs the output voltage to the pull-up driving unit where the test signal is a low level, and is floated where the test signal is a high level.

15. The internal voltage generation device according to claim 1, wherein the internal voltage driving block further comprises:

a voltage division unit configured to divide the internal voltage and output the divided voltage.

16. The internal voltage generation device according to claim 15, wherein the pull-up driving unit comprises a third PMOS transistor configured to supply the power supply voltage to an output terminal of the internal voltage in correspondence to the output voltage.

17. The internal voltage generation device according to claim 1, wherein the test signal is a signal which varies in correspondence to a level of a power supply voltage.

18. An internal voltage generation device comprising:

a voltage generation block configured to compare a reference voltage and a divided voltage, and generate an output voltage;

a pull-up driving unit configured to selectively pull-up drive an internal voltage according to the output voltage;

a test control unit configured to drive a test signal and output a first signal and a second signal;

a digital driving unit configured to control the output voltage to a logic level according to the first signal and the second signal which is an inverted signal of the first signal, and output the logic level to the pull-up driving unit; and an analog driving unit configured to output the output voltage to the pull-up driving unit according to the first signal and the second signal.

19. The internal voltage generation device according to claim 18, wherein the digital driving unit and the analog driving unit operate complementarily to each other in correspondence to the test signal.

20. An internal voltage generation device comprising:

a voltage generation block configured to generate an output voltage and amplify a resultant signal and output the output voltage; and an internal voltage driving block configured to receive the output voltage and pull-up drive a power supply voltage according to an output of a digital driving unit and an output of an analog driving unit, wherein the internal voltage driving block comprises:

a test control unit configured to drive a test signal and output a first signal and a second signal;

the digital driving unit configured to control the output voltage to a logic level according to the first signal and the second signal which is an inverted signal of the first signal, and output the logic level to a pull-up driving unit; and the analog driving unit configured to output the output voltage to the pull-up driving unit according to the first signal and the second signal.

21. The internal voltage generation device according to claim 20, wherein an internal voltage with a lower potential than an external supply voltage is used in a core region.

22. The internal voltage generation device according to claim 20, wherein the digital driving unit and the analog driving unit are selected according to the test signal.

23. The internal voltage generation device according to claim 22, wherein the test signal is a signal for sensing a level of the power supply voltage.

24. The internal voltage generation device according to claim 20, wherein the output voltage of the voltage generation block is transferred to the internal voltage driving block through different paths.

25. The internal voltage generation device according to claim 20, wherein when the power supply voltage decreases, the output voltage becomes a low level.

26. The internal voltage generation device according to claim 20, wherein when the power supply voltage increases, the output voltage becomes a high level.

27. The internal voltage generation device according to claim 25, wherein a level of an internal voltage is raised when the power supply voltage decreases.

28. The internal voltage generation device according to claim 26, wherein a level of an internal voltage remains constant when the power supply voltage increases.

29. The internal voltage generation device according to claim 20, wherein the digital driving unit is turned on and the analog driving unit is turned off when a test signal is at a high level.

30. The internal voltage generation device according to claim 20, wherein the analog driving unit is turned on and the digital driving unit is turned off when a test signal is at a low level.

* * * * *